US007225654B2

(12) United States Patent
Diaz Coello

(10) Patent No.: US 7,225,654 B2
(45) **Date of Patent: *Jun. 5, 2007**

(54) CANASTA FOR FORMING TUBES OF DIFFERENT DIAMETERS

(76) Inventor: Edgardo Xavier Diaz Coello, 6 de Marzo 4415, Guayaquil (EC)

( * ) Notice: Subject to any disclaimer, the term of this patent is extended or adjusted under 35 U.S.C. 154(b) by 499 days.

This patent is subject to a terminal disclaimer.

(21) Appl. No.: 10/761,570

(22) Filed: Jan. 21, 2004

(65) Prior Publication Data

US 2004/0250583 A1 Dec. 16, 2004

Related U.S. Application Data

(63) Continuation of application No. 10/152,329, filed on May 20, 2002, now Pat. No. 6,701,762.

(30) Foreign Application Priority Data

May 29, 2001 (EC) ..... 01/4090

(51) Int. Cl.
*B21C 37/12* (2006.01)

(52) U.S. Cl. ..... 72/49; 156/428

(58) Field of Classification Search ..... 72/49, 72/50; 156/425, 428, 429; 425/391
See application file for complete search history.

(56) References Cited

U.S. PATENT DOCUMENTS

| | | | |
|---|---|---|---|
| 2,539,853 | A | 1/1951 | Meyers et al. |
| 3,106,177 | A | 10/1963 | Nicolaisen |
| 3,263,321 | A | 8/1966 | Lombardi |
| 3,269,162 | A | 8/1966 | Fay |
| 4,058,996 | A | 11/1977 | Shaefer et al. |
| 4,070,886 | A | 1/1978 | Nyssen |
| 4,220,181 | A | 9/1980 | Nyssen |
| 4,337,564 | A | 7/1982 | Menzel et al. |
| 4,416,131 | A | 11/1983 | Davis |
| 4,438,643 | A | 3/1984 | Menzel et al. |
| 4,566,496 | A | 1/1986 | Menzel et al. |
| 4,616,495 | A | 10/1986 | Menzel |
| 4,622,838 | A | 11/1986 | Schafer |
| 4,630,650 | A | 12/1986 | Davis |
| 4,687,690 | A | 8/1987 | Menzel |
| 4,957,586 | A | 9/1990 | Keldany et al. |
| 4,977,931 | A | 12/1990 | Menzel |
| 5,024,712 | A | 6/1991 | Lecourt et al. |
| 5,108,283 | A | 4/1992 | Shaw et al. |

(Continued)

FOREIGN PATENT DOCUMENTS

| | | |
|---|---|---|
| AT | 354225 | 12/1979 |

(Continued)

*Primary Examiner*—Dmitry Suhol
(74) *Attorney, Agent, or Firm*—Scott D. Rothenberger; Dorsey & Whitney LLP

(57) ABSTRACT

In one embodiment, the subject invention includes a frame 10 comprising a front plate, a rear plate, a generally circular passage which extends through the frame, and rollers arranged, circumferentially positioned about the passage. The rollers are suspended within the passage by an adjustable arm which is mounted to the frame on one end, and is rotatably coupled to a roller on an opposite end. The adjustable arm includes a threaded rod that is rotatably mounted to a plate by a mounting plate and extension 18 which engages the rod and which travels longitudinally along the rod.

10 Claims, 4 Drawing Sheets

U.S. PATENT DOCUMENTS

| | | | |
|---|---|---|---|
| 5,468,322 | A | 11/1995 | Menzel |
| 6,701,762 | B2 | 3/2004 | Coello |

FOREIGN PATENT DOCUMENTS

| | | |
|---|---|---|
| AU | 417205 | 4/1971 |
| AU | PD6282 | 6/1978 |
| AU | 530251 | 4/1980 |
| AU | 5162279 | 4/1980 |
| CH | 671922 | 10/1979 |
| DE | 1527900 | 2/1970 |
| DE | 2754483 | 6/1978 |
| EP | 0011916 | 11/1980 |
| EP | 0288797 | 2/1988 |
| GB | 1182117 | 2/1970 |
| GB | 1557523 | 12/1979 |

CANASTA FOR FORMING TUBES OF DIFFERENT DIAMETERS

CROSS REFERENCE TO RELATED APPLICATIONS

This application is a continuation of U.S. Ser. No. 10/152,329, filed May 20, 2002, now U.S. Pat. No. 6,701,762, which claims priority to Ecuador SP-2001-4090, filed May 29, 2001, the contents of which are hereby incorporated by reference in their entirety.

TECHNICAL FIELD OF THE INVENTION

This invention relates generally to an apparatus for making tubular objects from a strip of material. More particularly, the invention relates to an apparatus which produces helically wound tubes or pipes of varying sizes from, preferably a continuous strip of material.

BACKGROUND OF THE INVENTION

Machines for helically winding strips of material into a pipe, tube, or other form of tubular objects are known. These machines typically receive a strip of material, e.g. a continuous strip, bend that material into a loop, and concurrently connect the newly formed loop onto an edge of an incoming portion of the strip. This process results in a helically wound tubular object which, depending upon the material of the strip, is suitable for a variety of uses. Tubular objects formed in this way are currently used as conduits, sewage pipes, or reels, just to name a few.

These machines usually include a circular rolling surface which receives the material and bends it into a loop. This rolling surface can comprise of a circular arrangement of rollers or a circular metallic band. The rollers or metallic band defines the radius of the formed tubular object.

The strip is typically fed into a machine along a bottom portion of the rolling surface and travels along the rolling surface to form a loop. As additional portions of the strip are fed into the roller assembly, an edge of the newly formed loop is guided to overlap an incoming strip portion along an edge. The overlapping edges are then connected so that the formed loop is eventually completely connected to an incoming portion of the strip.

The formed loops attach to the incoming strip portion in many ways. Some apparatus apply layers of adhesive along the edges of a strip and apply pressure along overlapping edges to adjoin the two. In more heavy duty applications, the strip is formed of a flexible plastic material having connecting structures incorporated along its edges. In these cases, the engaging structures on overlapping portions sealingly engage each other to sealingly connect the overlapping portions.

While the prior art is currently capable of making tubular objects from a continuous strip of materials, most of the prior art references are only capable of making tubular objects of one size. In many instances, tubular objects of different diameters are required and so the prior art necessitates either the use of only one size pipe for all applications or the use of multiple machines.

In many cases, the tubular objects produced are heavy duty pipes that provide a pathway for fluids or carry cables, and other structures. Often, newly wound pipes are directly inserted within preexisting underground piping or tunnels as they are formed. The appropriate diameter pipe is typically dependant upon the job site.

However, a new pipe forming machine is typically needed whenever a pipe of a different size is needed. The expediency of setting up and carrying just one machine for a given job, or the cost of additional pipe forming machines often prevent the use of multiple machines. As a result, the ideal diameter of pipe for a given site may not be used.

Consequently, there is a need for a pipe forming apparatus which is capable of being easily adjusted to create pipes of varying diameters from readily available strip material.

SUMMARY OF THE INVENTION

The present invention is an apparatus for making tubular objects of various diameters from a strip of material such as a continuous strip material. The present invention includes a unique circular rolling surface which is radially adjustable so that the apparatus is able to form tubular objects of different diameter.

In one embodiment, the subject invention includes a frame comprising of corresponding front and rear plates coaxially mounted to each other by a plurality of spacers. Each plate includes an aperture extending therethrough, the apertures overlaying each other to define a generally circular passage which extends through the frame. A plurality of slots extend through each plate, with each slot extending in a direction that is generally radial to the aperture.

A generally circular pathway is incorporated into the frame to receive and bend the strip of material as it passes through the subject invention. In one embodiment, the circular pathway is a rolling surface formed by a plurality of rollers disposed within the passage. The rollers are in a generally circular arrangement, circumferentially positioned about the passage.

In one embodiment, the rollers are suspended within the passage by an adjustable arm which is mounted to the frame on one end, and is rotatably coupled to a roller on an opposite end. Adjustable arms are correspondingly positioned between both plates so that the arms on one plate are aligned to the arms located on the opposing plate, thus allowing a roller to be rotatably coupled on both ends by an arm.

In one embodiment, the adjustable arm includes a threaded rod that is rotatably mounted to a plate or by a mounting plate. The rod includes a head portion and a threaded portion. The adjustable arm also includes an extension which engages a rod and a slot. A first end of the extension includes a flange shaped to engage a slot and a threaded ring to threadedly engage the threaded portion of the rod. A second end of the extension includes a coupling means for rotatably engaging the roller.

The diameter of a formed pipe can be changed by engaging the head portion of the rod and rotating the rod about its axis. The revolution of the rod causes the extension to travel longitudinally on the rod, this driven by the relative displacement of the threaded ring with respect to the threaded portion of the rod. This causes a radial movement of a roller relative to the passage. The rollers are individually adjusted until a desired diameter of pipe are produced.

While several embodiments are disclosed, still other embodiments of the present invention will become apparent to those skilled in the art from the following figures and detailed description. As will be realized, the invention is capable of modifications in various obvious aspects, all without departing from the spirit and scope of the present invention. Accordingly, the drawings and detailed description are to be regarded as illustrative in nature and not restrictive.

DETAILED DESCRIPTION OF THE INVENTION

The subject invention is an apparatus for creating tubular objects from a strip of material, such as a continuous strip material. For the purposes of describing the invention, the disclosed embodiment is directed towards an apparatus adapted to create plastic piping or conduits from a strip of plastic material. However, the subject invention is easily adapted to form other tubular objects utilizing strips made of different material.

Figure 1:
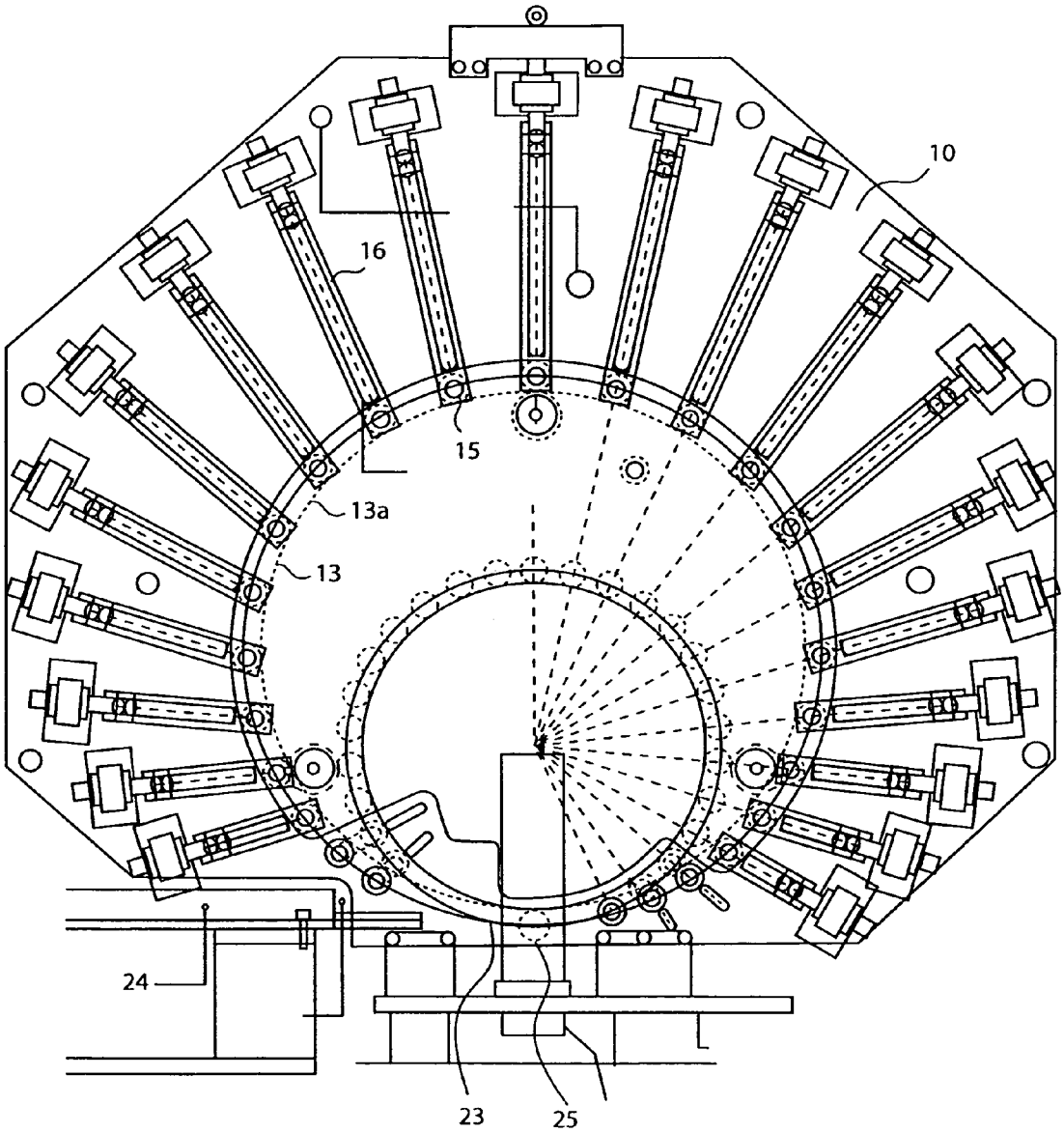
FIG. 1 is a rear view of one embodiment of the subject invention.
Figure 2:
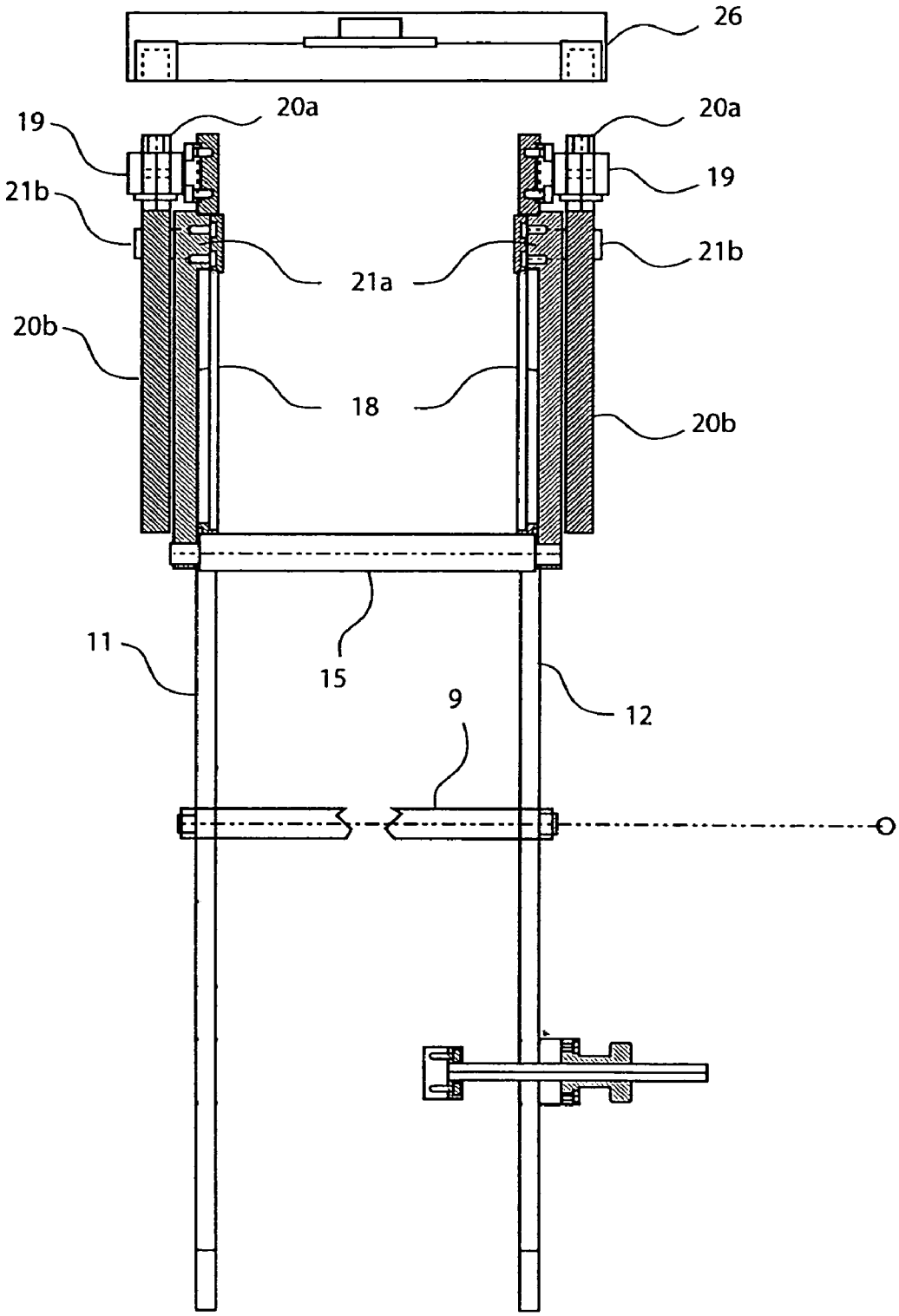
FIG. 2 is a partial, side view of the embodiment in FIG. 1 showing an embodiment of an adjustable arm.
Figure 4:
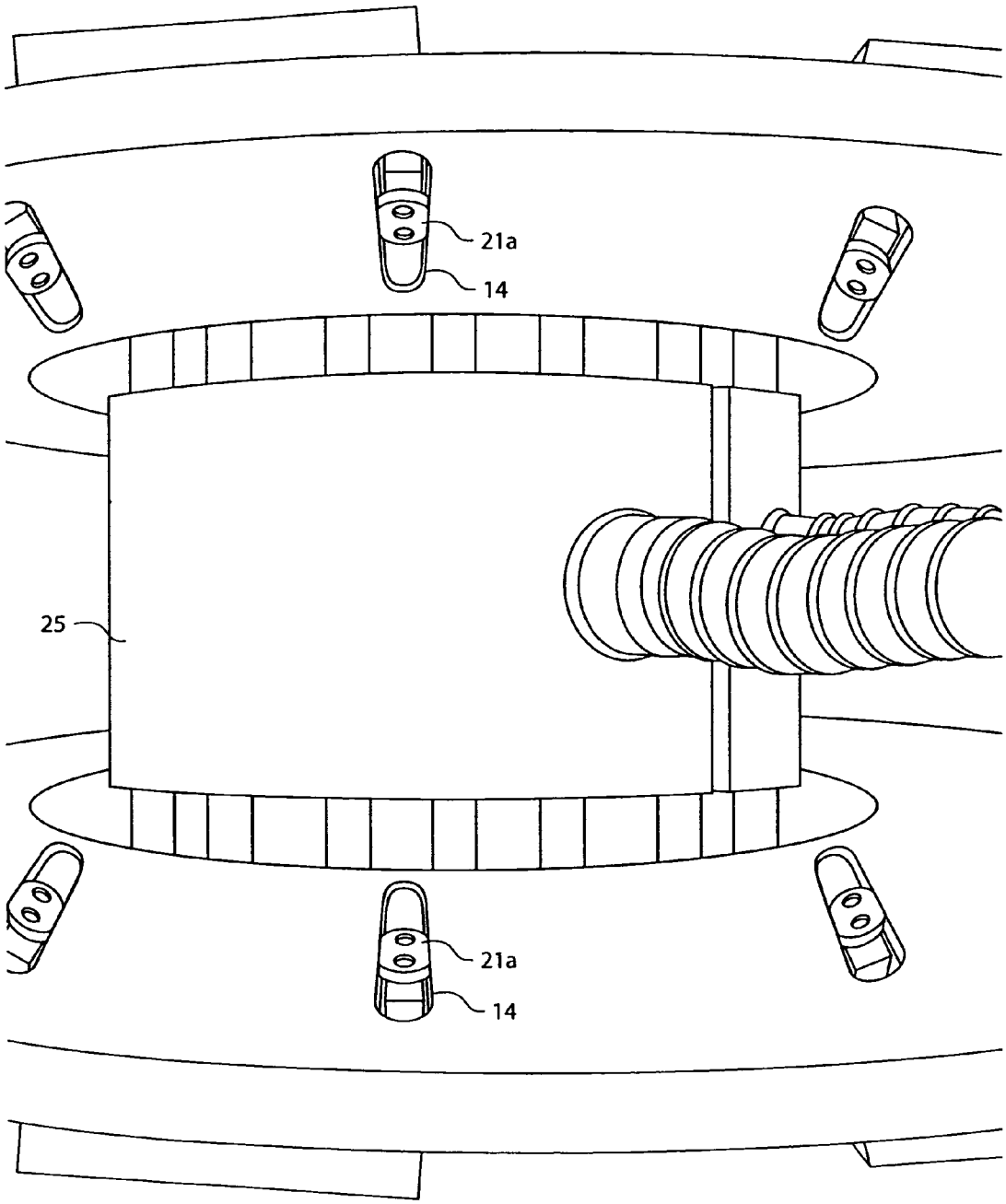
FIG. 4 is an enlarged, overhead view of the embodiment of FIG. 1.

As shown in FIGS. 1, 2, and 4, in one embodiment, the subject invention includes a frame 10 comprising a front plate 11, a rear plate 12, and a plurality of spacers 9 which connect the plates 11,12 to each other. The front 11 and rear 12 plates are generally octagonal shaped plates with each aligned in opposing and relatively coaxial position with respect to the other.

Each plate includes an aperture 13 extending therethrough with each aperture 13 generally coaxially positioned relative to the other. The apertures 13 defines a generally circular passage 13*a* which extends through the frame 10. As shown in FIG. 4, a plurality of slots 14 extend through each plate 11, 12 with each slot 14 extending in a direction that is generally radial to the aperture 13.

The shape of the frame 10 is not critical to the subject invention, and the frame 10 can comprise a number of different shapes. Furthermore, a housing can also be incorporated into the design of the subject invention to enclose the frame 10.

A generally circular pathway is incorporated into the frame 10 to receive and bend the strip of material as it passes through the subject invention. In one embodiment, the circular pathway is a rolling surface formed by a plurality of rollers 15 disposed within the passage 13*a*. The rollers 15 are in a generally circular arrangement, circumferentially positioned about the passage 13*a*.

As shown in FIGS. 1 and 2, in one embodiment, the rollers 15 are suspended within the passage 13*a* by an adjustable arm 16 which is mounted to the frame 10 on one end, and is rotatably coupled to a roller 15 on an opposite end. Each adjustable arm 16 is mounted to extend generally parallel to a plate 11,12 . The adjustable arms 16 are correspondingly positioned on both plates 11, 12 so that the arms 16 on one plate 11 or 12 positionally coincide to the arms located on the opposing plate 11 or 12, thus allowing a roller to be rotatably coupled on both ends by an arm 16.

Figure 3:
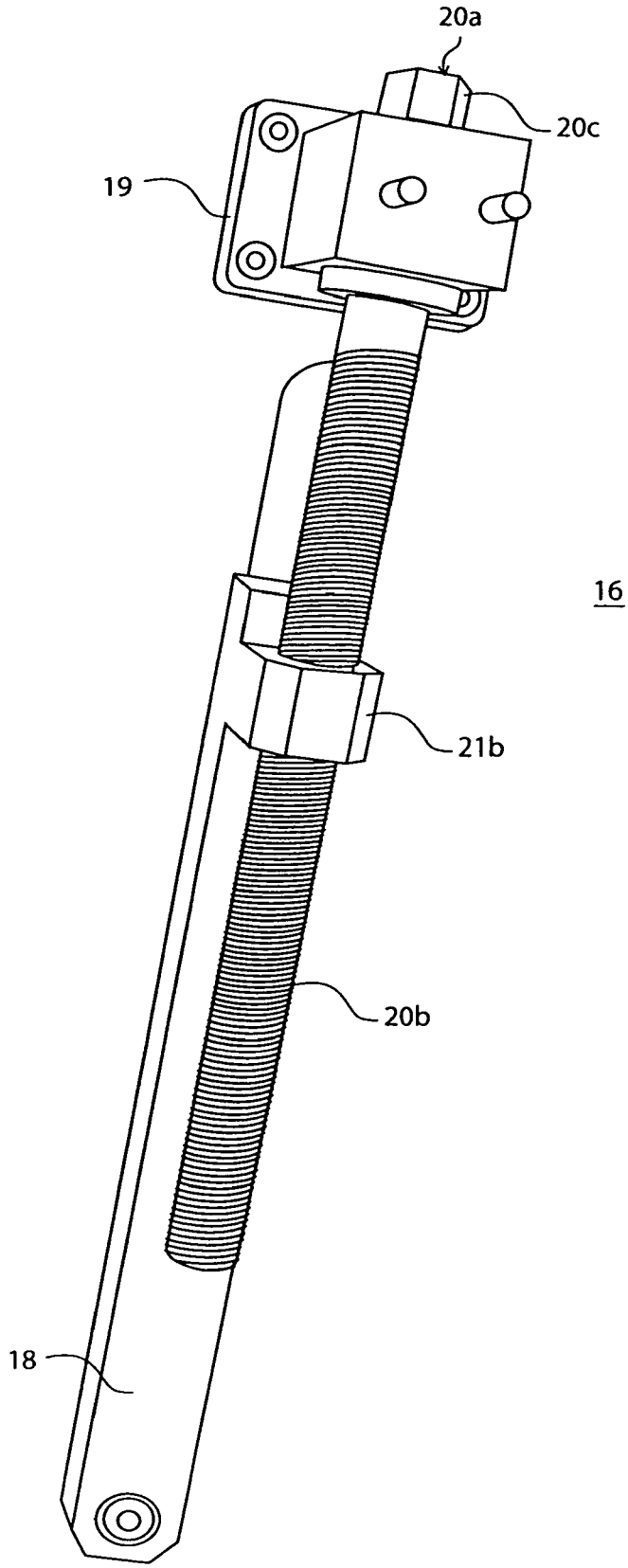
FIG. 3 is an enlarged, elevated, front view of an adjustable arm shown in FIG. 2.

As shown in FIGS. 2, 3, and 4, in one embodiment, the adjustable arm 16 includes a threaded rod 19 that is rotatably mounted to a plate 11 or 12. A mounting plate 19 rotatably locates the threaded rod 17 on a plate 11 or 12, and positions the rod in alignment with a slot 14, radially positioned relative to the aperture 13. The rod 17 includes a head portion 20*a* and a threaded portion 20*b*. The head portion 20*a* has engageable surfaces 20*c* used for rotating the rod 17.

The adjustable arm 16 also includes an extension 18 which simultaneously engages both the rod 17 and the slot 14. A first end of the extension 18 includes a flange 21*a* shaped to engage a slot 14 and a threaded ring 21*b* extending from the first end to threadedly engage the threaded portion 20*b* of the rod 17. A second end of the extension 18 includes a coupling means 22 for rotatably engaging the roller 15. The coupling means can be any known means for rotatably coupling a roller.

The extension 18 travels longitudinally in order to adjust the positioning of the roller 15 connected thereto. Upon rotation of the rod, the extension 18 is caused to travel longitudinally on the rod 17, driven by the relative displacement of the threaded ring 21*b* with respect to the threaded portion 20*b* of the rod. The flange 21*a* cooperates with the slot 14 to direct the extension 18 in a generally radial direction with respect to the aperture 13. The longitudinal movement of the extension 18 relative to the rod 17 results in a generally radial movement of the roller within the passage 13*a*.

The adjustable arm 16 may use other mechanisms known in the art in order to allow it to extend or contract longitudinally. An adjustable arm utilizing extending hydraulic or pneumatic components is also contemplated.

In operation, as shown in FIG. 1, the subject invention is fed a strip of material between a gap 23 in the lower portion of the rolling surface. In order to maintain consistent feeding, a feeder mechanism 24 can be used to feed the strip of material. The feeder mechanism can be any conveyor type apparatus known in the art that is adapted to deliver the strip material to the lower portion of the claimed apparatus. Feeding can also be accomplished by purely manual means.

Upon entering the gap 23, the strip of material completes an initial revolution around the circular pathway defined by the rollers 15. The strip is guided so that a second edge of a revolved portion of the strip will overlap a first edge of an incoming portion of the strip. The overlapping edges are then secured to each other creating a seal therebetween. This process of securing the revolved second edge to an incoming first edge creates a continuous helically wound tubular object, such as a pipe. A cutting mechanism can also be incorporated into the present invention to cut the formed tubular object at a desired length.

In one embodiment, the strip used to form the wound tubular object is a flexible plastic material having connecting structures incorporated along its first and second edges. As shown in FIG. 1, a roller mechanism 25 applies pressure to the two strips which forces the connecting structures to engage each other, creating a seal between the revolved second edge and the incoming first edge. As shown in FIG. 4, a plenum 24 carrying heat from a heat source may also be incorporated into the subject invention to soften the plastic material either to increase the flexibility of the strip material or to aid in the engagement of the connecting structures.

The revolved second edge can be attached to the incoming first edge in many other ways. In some applications a layer of adhesive is placed along the first and second edges of the strip, and pressure is applied along the overlapping edges to adjoin the two. Other known methods of connecting the edges can easily be adapted.

The diameter of a formed pipe can be changed by engaging the engageable surfaces on the head portion 20*a* of the rod 17 and rotating the rod 17 about its axis. The revolution of the rod 17 causes the extension 18 to travel longitudinally on the rod 19, this motion driven by the relative displacement of the threaded ring 21*b* with respect to the threaded portion 20*b* of the rod. The rods are individually adjusted until a desired diameter of pipe are produced.

As shown in FIG. 2, a double spanner apparatus can be used to simultaneously engage the engageable surfaces of opposing rods 17. The double spanner enables the head portions 20*a* of opposing rods 17 to be rotated in unison, enabling the roller to be adjusted evenly on both ends.

While the present invention has been described with reference to several embodiments thereof, those skilled in the art will recognize various changes that may be made without departing from the spirit and the scope of the claimed invention. Accordingly, this invention is not limited to what is shown in the drawings and described in the specification, but only as indicated in the appended claims.

The invention claimed is:

1. A method for forming a tubular object, comprising the step of:

engaging a strip of material, having a first edge and a second edge, about a series of rollers, such that the strip of material completes a revolution in an apparatus for forming tubular objects from a strip of material, wherein the apparatus comprises:

a frame, wherein the frame includes a front plate and a rear plate connected to each other by a plurality of spacers;

a plurality of adjustable arms, each of which individually are longitudinally extendable, are mounted about the front and rear plates and are positioned in a generally semi-circular arrangement about the frame, wherein two adjustable arms are correspondingly mounted relative to each other on the opposite plates; and a roller is rotatably coupled to each pair of adjustable arms that are correspondingly mounted relative to each other about the frame, such that each roller is individually positionable in a radial direction; and securing the first edge of the strip to the second edge of the strip in a helical fashion, thereby forming a tubular pipe.

2. The method of claim 1, wherein one or more of the adjustable arms include a threaded rod, and an extension in threaded engagement to the threaded rod.

3. The method of claim 2, wherein each plate includes an aperture extending therethrough and slots extending radially from the aperture, and wherein the extension includes a flange which engages a slot.

4. The method of claim 2, wherein the threaded rod includes a threaded portion, and the extension includes a threaded ring that engages the threaded portion of the threaded rod.

5. The method of claim 1, wherein each plate is generally octagonal and has an aperture extending therethrough.

6. The method of claim 1, further comprising a plenum coupled to the frame, and a heating source in communication with the plenum.

7. The method of claim 1, further comprising a feeder mechanism coupled to the frame.

8. The method of claim 1, and further comprising a cutting mechanism coupled to the frame.

9. The method of claim 1, wherein the first edge and the second edge of the strip of material have interconnecting structures that form a seal when joined together.

10. The method of claims 1, wherein the first edge of the second edge of the strip of material are adhesively bonded together to form a seal when joined together.

* * * * *